United States Patent [19]

Burr

[11] Patent Number: 4,519,719

[45] Date of Patent: May 28, 1985

[54] EARTH BORING BIT WITH PRESSURE COMPENSATING BEARING SEAL

[75] Inventor: Bruce H. Burr, Houston, Tex.

[73] Assignee: Hughes Tool Company, Houston, Tex.

[21] Appl. No.: 559,651

[22] Filed: Dec. 9, 1983

[51] Int. Cl.[3] ..... F16C 33/74

[52] U.S. Cl. ..... 384/94

[58] Field of Search ..... 384/94, 93; 175/371; 277/95, 102, 124, 188 R, 188 A, 77

[56] References Cited

U.S. PATENT DOCUMENTS 4,014,595 3/1977 Dolezal .

4,019,785 4/1977 Stinson .

4,176,848 12/1979 Lafuze ..... 384/94

4,199,156 4/1980 Oldham et al. ..... 277/92

4,466,621 8/1984 Garner et al. ..... 277/95

*Primary Examiner*—Lenard A. Footland

*Attorney, Agent, or Firm*—Robert A. Felsman

[57] ABSTRACT

An earth boring bit having a pressure compensating seal assembly which includes a resilient packing ring, a rigid backup ring and a wave spring to permit axial displacement of the resilient ring in an elongated seal groove while resisting destructive distortions of the resilient ring. The lubrication system has a lubricant volume correlated with the volume of the passages and spaces and the maximum seal displacement. A measured amount of lubricant is withdrawn from the system during assembly for subsequent compression as the bit is lowered into a liquid-filled bore hole to position the seal assembly intermediate the end walls of the seal groove.

12 Claims, 7 Drawing Figures

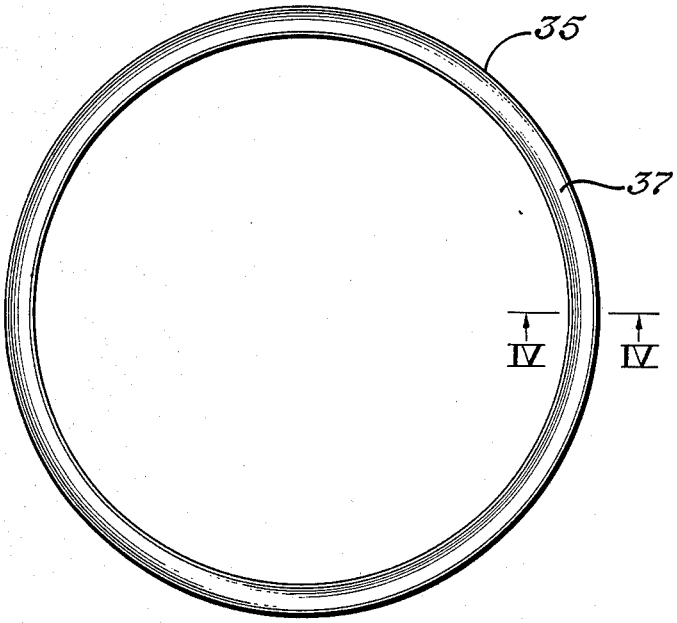
Fig. 3
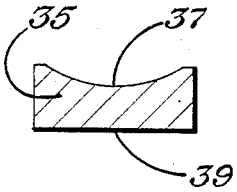
Fig. 4
Fig. 5
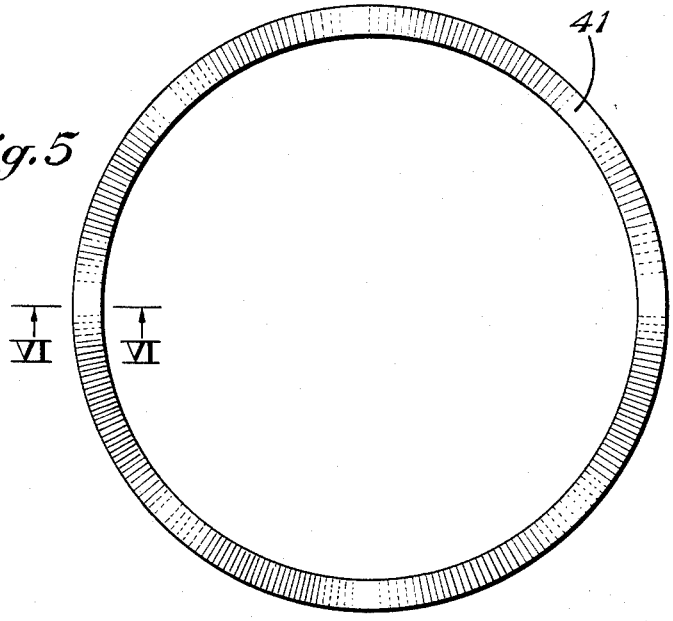
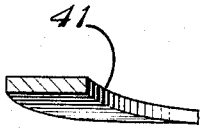
Fig. 6
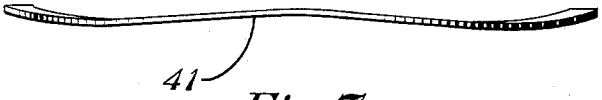
Fig. 7

EARTH BORING BIT WITH PRESSURE COMPENSATING BEARING SEAL

CROSS REFERENCE TO RELATED APPLICATION

This invention relates to subject matter of the general type disclosed in my co-pending application, Ser. No. 542,801, filed 10-17-83, "Earth Boring Bit With Pressure Compensating Rigid Face Seal" in that the seals of each have the capability of moving axially in response to pressure differentials across the seal or volume changes in the lubricant adjacent the seal.

BACKGROUND OF THE INVENTION

1. Field of the Invention

This invention relates to earth boring bits lubricated with a seal system that retains lubricant in the bearings of the bit while excluding ambient drilling fluid. Specifically, the invention relates to improvements in the pressure compensating systems of such bits that minimize the pressure differential across the seals.

2. Background Information

The commercially successful, contemporary earth boring bit has rotatable cutters supported upon cantilevered bearing shaft and a system to provide lubricant to the bearings. A seal ring is utilized to retain lubricant inside each bearing, the most prevalent seal and bearing system being that of Edward M. Galle, U.S. Pat. No. 3,397,928.

A compensator system is included in earth boring bits for the purpose of minimizing the pressure differential across the seals. An example of a successful compensating system may be seen in the patent of Stuart C. Millsapps, Jr., U.S. Pat. No. 4,276,946, which utilize a flexible membrane or bladder, to separate drilling fluid from the lubricant and induce the hydrostatic pressure of the drilling fluid upon the lubricant. Thus, lubricant pressure is equal to the hydrostatic pressure when the bit is in a static condition. During drilling, there is movement of the cutter on the shaft due to the clearances necessary for manufacture and assembly. This movement changes the volume of lubricant within the bearing and tends to move the seal in its groove.

George Edward Dolezal discloses in U.S. Pat. No. 4,014,595 a bit that achieves pressure compensation by providing sufficient displacement of the seal, preferably an o-ring, to accommodate changes in the lubricant volume caused by cone movement and temperature changes encountered during drilling. By minimizing the volume of lubricant in the system, seal displacement is minimized to produce pressure equalization or compensation across the seal without need for additional compensation. This simplifies the lubrication system and should have enhanced reliability.

Leon Berthal Stinson and Edward M. Galle in U.S. Pat. No. 4,019,785 disclose a bit which included a lubrication system that achieves internal bearing pressure control through utilization of the thermal expansion of the lubricant, seal displacement and a pressure relief valve. Since the temperature of the earth generally increases with depth from the surface, a drill bit experiences increasing temperature with increasing depth. The coefficient of thermal expansion of lubricant inside the bit is greater than that of the metal defining the walls of lubricant cavities. The resulting increases in pressure caused by temperature increases of the lubricant is relieved by a pressure relief means, which can eliminate the necessity for a flexible diaphram-type pressure compensator.

In my above co-pending application, I disclosed a bit which utilizes a conventional pressure compensator of the type shown in Stuart C. Millsapps' U.S. Pat. No. 4,276,946 in combination with a metal face or rigid ring seal having the ability to compensate for the rapid or dynamic changes in volume in the lubricant adjacent the seal as the cutter moves during drilling. As a consequence, the seal ring is protected from static and dynamic pressure changes.

SUMMARY OF THE INVENTION

The general object of the invention is to provide an improved drill bit with a pressure compensating seal system that eliminates the need for a conventional hydrostatic pressure compensator. In the preferred embodiment, the seal assembly has a resilient seal ring, preferably of the o-ring type, an axially moveable, rigid ring, backed by a spring such that the rigid ring resists the axial displacement of the resilient seal to limit distortion of the resilient seal ring. The axial displacement of the seal ring is sufficient to accommodate volume changes of the lubricant and the volume of the spaces and passages is correlated with the maximum seal displacement. Additional features, objects and advantages of the invention will be apparent in the following description.

BRIEF DESCRIPTION OF THE DRAWINGS

FIG. 3 is a frontal view of a backup ring used in the seal assembly.

FIG. 4 is a cross-sectional view as seen looking along the arrows 4—4 of FIG. 3.

FIG. 5 is a frontal view of the wave spring shown in FIGS. 1 and 2.

FIG. 6 is a cross-sectional and fragmentary view as seen looking along the arrows 6—6 of FIG. 5.

FIG. 7 is an edge view of the spring shown in FIG. 5.

DESCRIPTION OF THE PREFERRED EMBODIMENT

Figure 1:
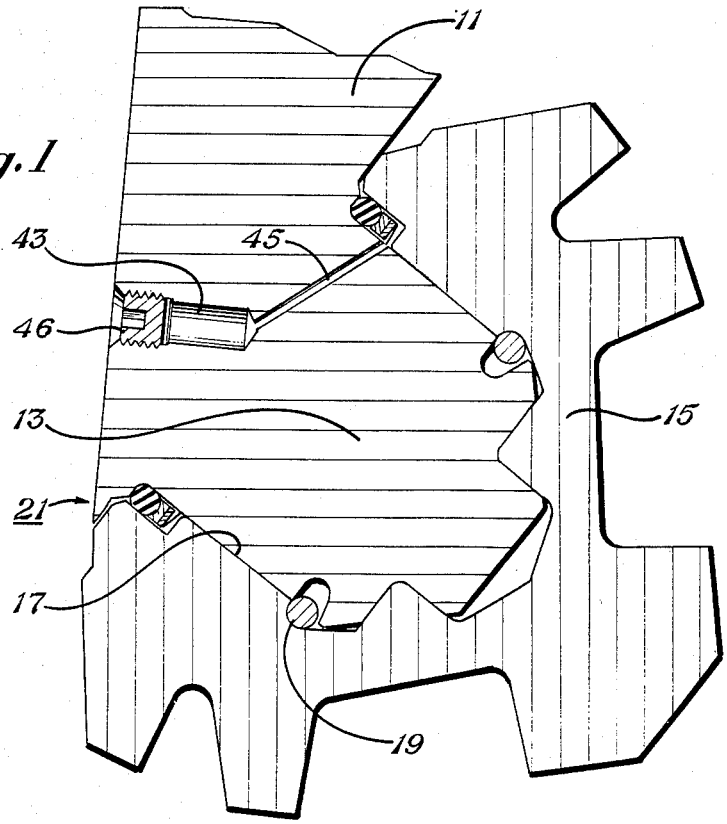
FIG. 1 is a fragmentary view in longitudinal section of the lower portion of a rock bit leg, a rotatable cutter secured to a cantilevered bearing shaft on the leg, and the preferred seal assembly and lubrication system.

Referring initially to FIG. 1 of the drawings, the numeral 11 designates one leg of a bit body which commonly consists of three legs, each having a bearing shaft 13 extending inwardly and downwardly toward the centerline (not shown) of the body. Supported on each of the bearing shafts is a rotatable cutter 15 having an internal bearing cavity 17, with a configuration to mate with bearing surfaces formed on the bearing shaft 13. The bearing and cutter design is conventional, including a snap ring 19 used to retain each cutter on the associated bearing shaft 13. A preferred construction of the snap ring and associated groove configuration may be seen in the patent of Leroy W. Ledgerwood, III, U.S. Pat. No. 4,344,658.

Figure 2:
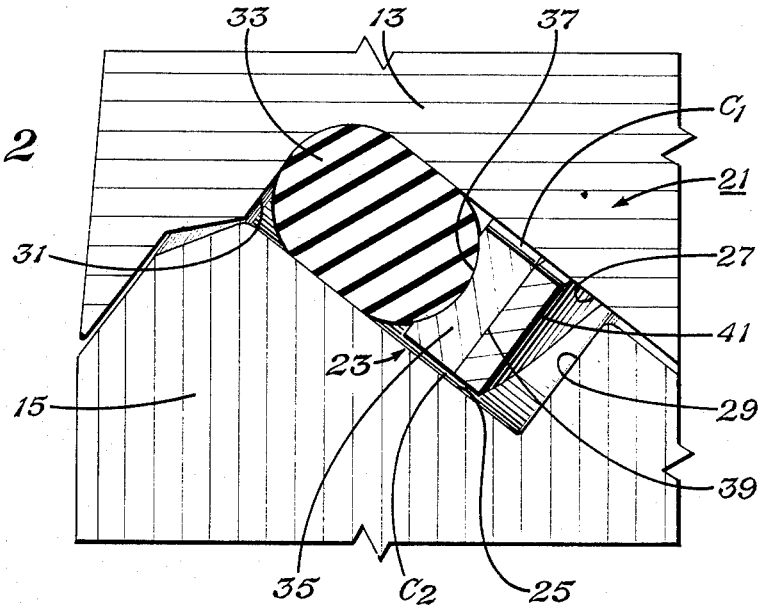
FIG. 2 is a fragmentary view in longitudinal section of the seal assembly shown in FIG. 1, enlarged to show the assembly in greater detail.

The seal assembly is designated in general by the numeral 21, and may best be seen with reference to FIG. 2 of the drawings. A seal groove 23 is formed between the cutter and shaft, having generally circumferential, inner and outer walls 25, 27, the wall 25 being on the cutter 15 and the wall 27 being on the shaft 21. Further, there are generally radial, inner and outer end walls 29, 31, the inner end wall 29 being formed on the cutter 15 and the outer end wall 31 being formed on the bearing shaft 13.

Disposed within the groove 23 is a seal ring 33, which in this instance is a resilient packing ring of the o-ring type, having its cross-sectional thickness squeezed between the outer and inner circumferential walls 25, 27 in the manner taught in the patent of Edward M. Galle, U.S. Pat. No. 3,397,928. Further, the seal ring 33 is disposed in the groove 23 to oppose the radial end wall 31. An axially moveable rigid ring 35 opposes and engages an innermost annular portion of the o-ring 33. Rigid ring 35 has clearances $C_1$ and $C_2$ respectively from the outer circumferential wall 25 and the inner circumferential wall 27 to permit unrestricted axial motion within the groove 23. An innermost wall 39 is preferably planar, while the outermost surface 37 is curved, as seen in cross-section, to engage and oppose the curvature of the seal ring 33. The frontal view of the rigid ring 35 as seen in FIG. 3 discloses its annular shape, and its cross-sectional configuration may be seen with reference to FIG. 4.

Also disposed within the seal groove 23 is a spring means 41, which here is a wave spring seen with reference to FIGS. 5, 6 and 7. The frontal view in FIG. 5 shows the annular shape of the ring, FIG. 6 shows its preferred rectangular cross-section, and FIG. 7 shows the wave form in an edge view. This wave spring also has radial clearances with respect to the inner circumferential wall 27 and the outer circumferential wall 25.

The bit includes a lubrication system having a reservoir 43 (see FIG. 1) through which lubricant is filled through the passage 45, into the seal groove and the various passages and spaces between the bearing shaft 13 and the cutter 15. A threaded plug 46 is inserted into the threaded portion of the reservoir 43 to seal lubricant within the system. A vacuum filling system is utilized to fill the bit with lubricant, a suitable process and apparatus being disclosed in the patent to Leon Berthal Stinson and Edward M. Galle, U.S. Pat. No. 4,019,785. During the lubrication process, the pressurized lubricant urges the seal ring 33 against the outer radial end wall 31. Then, a measured amount of lubricant is withdrawn from the reservoir 43 and seal plug 46 inserted. Thus, there is a predetermined gas-filled space in the reservoir that will compress when the bit is lowered into a liquid-filled well bore. This positions the seal ring 33 between the end walls 29, 31 of the seal groove 23 if the volume of the gas-filled space and the lubricant within the bit is correlated with the maximum displacement of the resilient ring. Movement of the resilient ring can then compensate for volume changes in the lubricant during drilling in the manner disclosed by George Edward Dolezal in U.S. Pat. No. 4,014,595. Alternatively, the relief valve system disclosed in U.S. Pat. No. 4,019,785 may be utilized.

In operation, the seal ring 33 is initially positioned during lubrication as shown in FIGS. 1 and 2 such that it engages the outer radial end wall 31 of the seal groove 23. As the bit is lowered into a liquid-filled well bore, the increasing hydrostatic pressure moves the seal ring 33 inwardly in seal groove 23 until the volume of gas provided in reservoir 43 during assembly is compressed. This positions the seal 33 in an intermediate position in the seal groove 23 during drilling such that it may move inwardly or outwardly to compensate for volume changes in the lubricant. Volume changes in the lubricant occur in the seal groove due to the movement of the cutter on the shaft, since there are clearances provided to assure assembly of the cutter on the shaft. Furthermore, volume increases occur due to temperature increases as a result of the geothermal gradient and as a result of the heat of friction as the cutter rotates on the bearing shaft.

One of the problems which sometimes occurs in connection with the structure shown in U.S. Pat. No. 4,014,595 is associated with the relatively large axial displacement of the o-ring. A seal ring, particularly one of the o-ring type, performs best when the seal groove width is larger than the compressed width of the o-ring by an amount usually specified in the catalogs of the o-ring manufacturers. The use of the backup ring and biasing means of this invention restricts the positioning of the o-ring in a manner that permits axial movement sufficient to accomplish the desired compensation but in a manner that protects the seal from assuming positions that lead to premature damage and failure.

While the invention has been shown in only its preferred form, it should be apparent to those skilled in the art that it is not thus limited, but is susceptible to various changes and modifications without departing from the spirit thereof.

I claim:

1. An earth boring bit with an improved pressure compensating seal assembly, which comprises:

a body, a cantilevered bearing shaft extending obliquely inwardly and downwardly from the body;

a cutter secured for rotation about the bearing shaft;

a seal groove between the cutter and the shaft to have generally circumferential walls, one on the cutter and the other on the shaft, and generally radial, inner and outer end walls;

a seal ring disposed in the seal groove opposing and sealingly enaging both the circumferential walls as well as opposing selected end wall;

an axially movable, rigid ring disposed in the seal groove between the seal ring and the other of said end walls;

spring means positioned between said other end wall and the rigid ring;

lubricant in passages and spaces in the bit, including those between the cutter and the shaft;

the axial displacement of the seal ring within the seal groove being resisted by the rigid ring to limit distortions of the seal ring.

2. An earth boring bit with an improved pressure compensating seal assembly, which comprises:

a body;

a cantilevered bearing shaft extending obliquely inwardly and downwardly from the body;

a cutter secured for rotation about the bearing shaft;

a seal groove between the cutter and the shaft to have generally circumferential walls, one on the cutter and the other on the shaft, and generally radial, inner and outer end walls;

a seal ring disposed in the seal groove to oppose the circumferential walls as well as a selected end wall;

an axially movable, rigid ring disposed in the seal groove between the seal ring and the other of said end walls;

spring means positioned between said other end wall and the rigid ring;

lubricant in passages and spaces in the bit, including those between the cutter and the shaft;

the axial displacement of the seal ring within the seal groove being resisted by the rigid ring to limit distortions of the seal ring;

the seal ring being a resilient packing ring and the spring means being a wave spring.

3. The invention defined by claim 2 wherein the resilient packing ring is an o-ring.

4. An earth boring bit with an improved pressure compensating seal assembly, which comprises:

a body;

a cantilevered bearing shaft extending obliquely inwardly and downwardly from the body;

a cutter secured for rotation about the bearing shaft;

a seal groove between the cutter and the shaft to have generally circumferential walls, one on the cutter and the other on the shaft, and generally radial, inner and outer end walls;

a resilient packing ring of the o-ring type disposed in the seal groove opposingly and sealingly engaging both the circumferential as well as opposing the outer end wall;

an axially movable, rigid back-up ring disposed in the seal groove between the packing ring and the inner end wall;

an annular spring positioned between the inner end wall and the back-up ring to engage the rigid ring while permitting axial movement in the groove;

lubricant in passages and spaces in the bit, including those between the cutter and shafts;

the axial displacement of the resilient packing ring within the seal groove being sufficient to accommodate volume changes of lubricant.

5. The invention defined by claim 4 with the volume of the spaces and the lubricant in the bit being correlated with the maximum displacement of the resilient ring to compensate for lubricant volume changes.

6. The invention defined by claim 5 wherein the seal ring is a resilient packing ring and the spring means is a wave spring.

7. The invention defined by claim 6 wherein the resilient packing ring is an o-ring.

8. An earth boring bit with an improved pressure compensating seal assembly, which comprises:

a body;

a cantilevered bearing shaft extending obliquely inwardly and downwardly from the body;

a cutter secured for rotation about the bearing shaft;

a seal groove between the cutter and the shaft to have generally circumferential walls, one on the cutter and the other on the shaft, and generally radial, inner and outer end walls;

a resilient packing ring of the o-ring type disposed in the seal groove to oppose the circumferential as well as the outer end walls;

an axially movable, rigid back-up ring disposed in the seal groove between the packing ring and the inner end wall;

an annular spring positioned between the inner end wall and the back-up ring to engage the rigid ring while permitting axial movement in the groove;

lubricant in passages and spaces in the bit, including those between the cutter and shaft;

the axial displacement of the resilient packing ring within the seal groove being sufficient to accommodate volume changes of the lubricant;

the seal ring being a resilient packing ring and the annular spring being a wave spring.

9. The invention defined by claim 8 wherein the resilient packing ring is an o-ring.

10. The invention defined by claim 5 wherein the lubricant fills all but a predetermined gas-filled space during assembly to compress when lowered in a liquid-filled well bore to position the packing ring intermediate the end walls of the seal groove.

11. The invention defined by claim 10 wherein the seal ring is a resilient packing ring.

12. The invention defined by claim 11 wherein the resilient packing ring is an o-ring.

* * * * *